US005139111A

United States Patent [19]

Baumann et al.

[11] Patent Number: 5,139,111

[45] Date of Patent: Aug. 18, 1992

[54] GLASS DOOR LEAF FOR ELEVATORS

[75] Inventors: Hugo Baumann, Kriens; Peter Stöckli, Goldau, both of Switzerland

[73] Assignee: Iventio AG, Hergiswil, Switzerland

[21] Appl. No.: 744,259

[22] Filed: Aug. 13, 1991

[30] Foreign Application Priority Data

Aug. 14, 1990 [CH] Switzerland ..... 02633/90

[51] Int. Cl.[5] ..... B66B 13/00

[52] U.S. Cl. ..... 187/51; 187/1 R; 52/208

[58] Field of Search ..... 187/1 R, 51, 56; 49/116, 120, 472, 504; 52/204, 208

[56] References Cited

U.S. PATENT DOCUMENTS 4,324,373 4/1982 Zibritosky ..... 52/208
4,530,189 7/1985 Randall ..... 187/1 R
4,905,432 3/1990 Romie ..... 52/208

*Primary Examiner*—Robert P. Olszewski
*Assistant Examiner*—Kenneth Noland
*Attorney, Agent, or Firm*—William J. Clemens

[57] ABSTRACT

A glass door leaf for elevator shaft and car doors has a glass pane connected at its lower edge with a guide shoe plate and at its upper edge with a hanger bracket. Eccentric pins with guide shoes are attached to the guide shoe plate and enter into a threshold profile for the sliding guidance of the glass door leaf at its lower end along the displacement path of the door. The glass pane is retained at the lower end between a lower base strip and a glass-retaining strip of the guide shoe plate and retained at the upper end between an upper base strip and the hanger bracket. Rubber bushings extend through apertures formed in the glass pane and encompass fastening nuts which are inserted from the elevator shaft side and are connected with welding pins attached to the base strips. A carrier holds a guide rail which extends along the displacement path and engages rollers which carry the glass door leaf and are mounted on the hanger bracket. A raised collar formed on each roller edge assures a secure guidance and prevents the glass door leaf from jumping off the guide rail.

18 Claims, 8 Drawing Sheets

GLASS DOOR LEAF FOR ELEVATORS

BACKGROUND OF THE INVENTION

The present invention concerns elevator doors in general and, in particular, a glass door leaf with a smooth surface on the user side for elevators.

An elevator door having a glass pane, which pane is retained in a door frame by a mounting frame, is shown in the West German utility model number GM F 2063. The glass pane is ground obliquely along all edges and is inserted into the elastic mounting frame which is provided with an oblique portion and screwed together flush with the door frame by means of a bevelled clamping strip. In this manner, a completely smooth surface is provided without any risk of danger for the elevator user in respect of getting caught by sharp edges. Furthermore, the smooth surface offers an attractive appearance.

A disadvantage of the above-described frame assembly is that an expensive manufacturing process is necessary to produce the glass pane with associated high manufacturing costs. A further disadvantage is that glass panes clamped along oblique edges tend to have increased susceptibility to fracture upon the application of force.

SUMMARY OF THE INVENTION

The present invention avoids the disadvantages of the above-described known equipment and provides elevator doors with glass panes which meet the demands of the present day safety regulations in respect of resistance to applied loads or forces. A glass door leaf for elevators includes a glass pane having apertures formed at an upper end and a lower end thereof; a lower base strip having welding pins attached thereto extending into the apertures in the lower end of the glass pane for retaining the lower base strip on the glass pane; and a glass-retaining strip mounted on an opposite side of the glass pane from the lower base strip at the lower end by fastening nuts engaging the welding pins attached to the lower base strip. The door leaf further includes an upper base strip having welding pins attached thereto extending into the apertures in the upper end of the glass pane for retaining the upper base strip on the glass pane; a hanger bracket mounted on an opposite side of the glass pane from the upper base strip at the upper end by fastening nuts engaging the welding pins attached to the upper base strip; a guide shoe strip mounted on the lower end of the glass pane with eccentric pins extending downwardly therefrom; and guide shoes attached to the eccentric pins. The glass-retaining strip and the guide shoe strip are connected together to form either a T-shaped guide shoe plate or an L-shaped guide shoe plate. A steel edge strip can be attached to an abutting edge of the glass pane in a closing region, or the glass pane can be encompassed by a frame, or a glass edge strip can be attached to the abutting edge, or the glass pane can be without edge strips.

The advantages achieved by the present invention are that the elevator doors can be manufactured to correspond to the modern trend of making mechanisms visible in function and structure by using glass as a construction material. A further advantage is that the possibilities for the aesthetics of elevator doors are improved, in particular for panorama type elevators.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
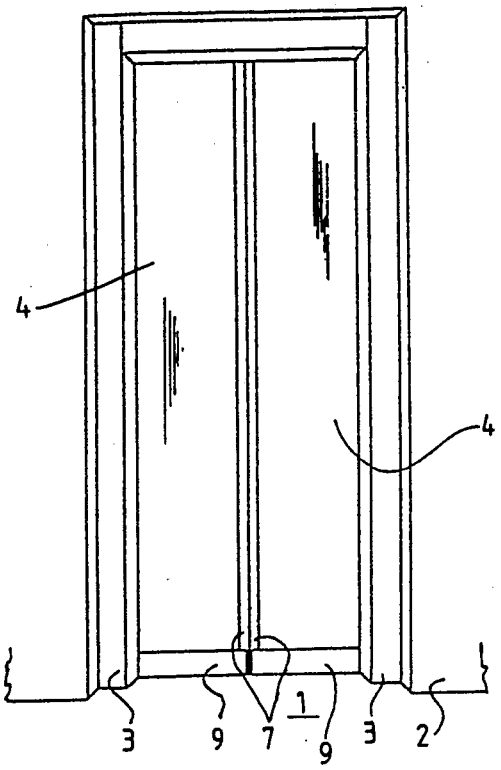
FIG. 1 is a front elevation view of an elevator entryway with shaft and car doors in the closed position and having glass door leaves with abutting steel edge strips.
Figure 3:
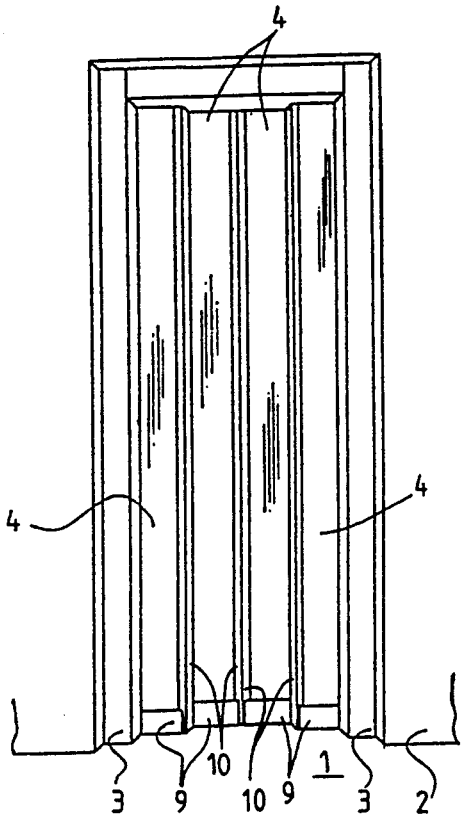
FIG. 3 is a view similar to the FIG. 1 showing the shaft and car doors encompassed by frames.
Figure 2:
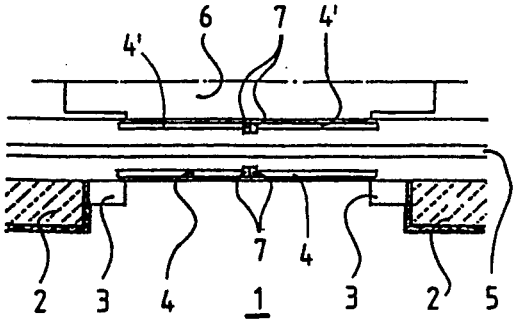
FIG. 2 is a top plan view of the elevator doors shown in the FIG. 1.
Figure 4:
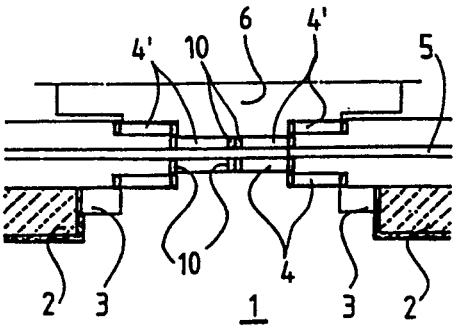
FIG. 4 is a top plan view of the elevator doors shown in the FIG. 3.
Figure 5:
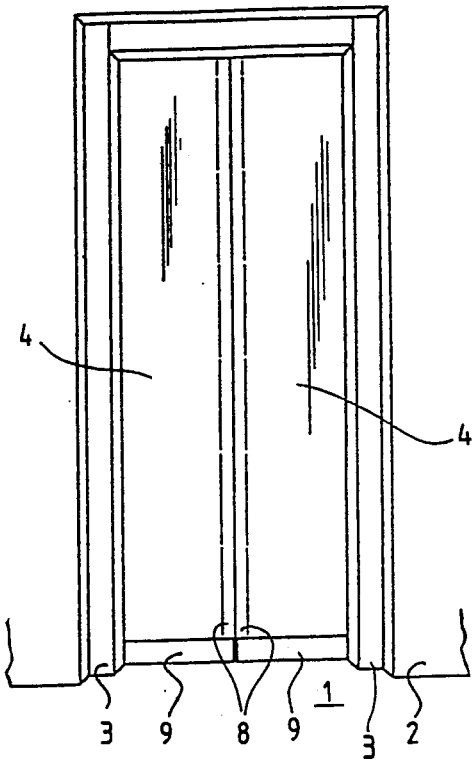
FIG. 5 is a view similar to the FIG. 1 showing the shaft and car doors with abutting glass edge strips.
Figure 7:
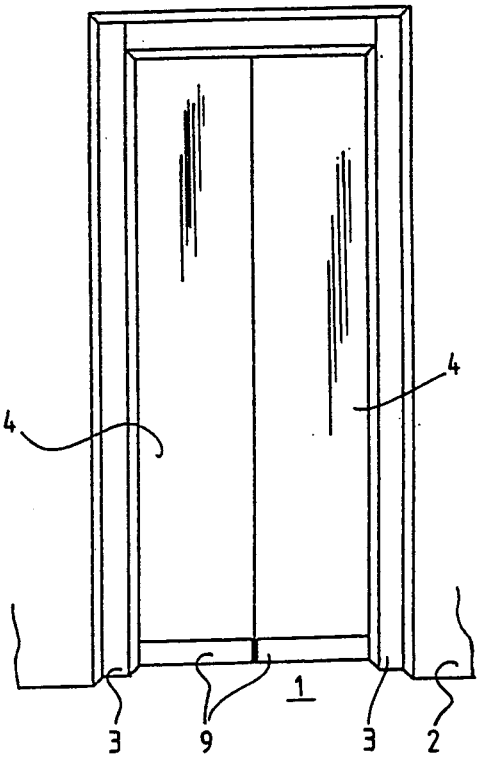
FIG. 7 is a view similar to the FIG. 1 showing the shaft and car doors without edge strips.
Figure 6:
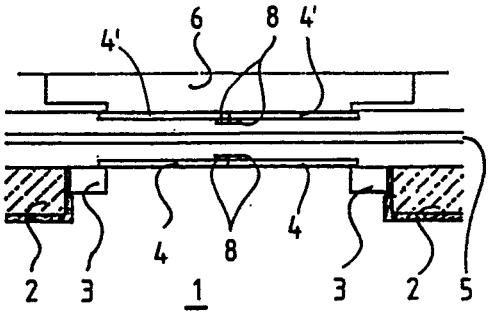
FIG. 6 is a top plan view of the elevator doors shown in the FIG. 5.
Figure 8:
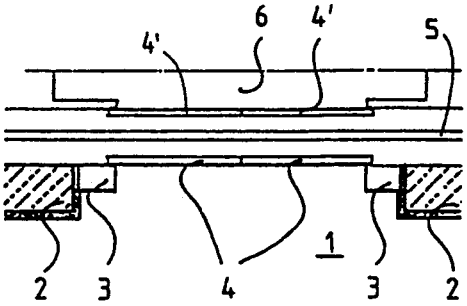
FIG. 8 is a top plan view of the elevator doors shown in the FIG. 7.
Figure 10:
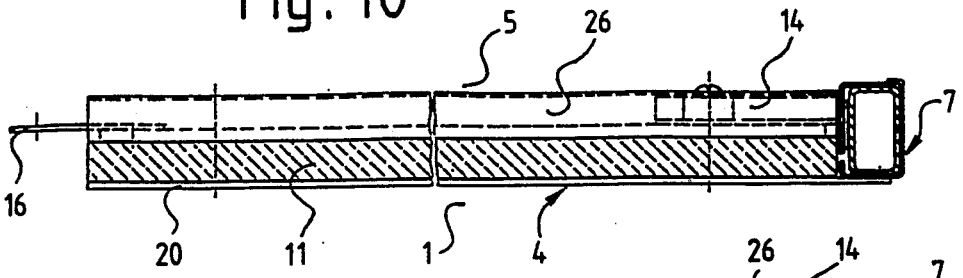
FIG. 10 is a cross-sectional view taken along the line B—B through the shaft door as shown in the FIG. 9.
Figure 11:
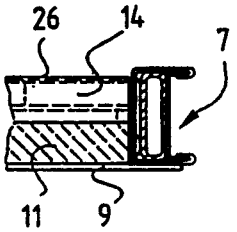
FIG. 11 is a cross-sectional view taken along the line B—B through the car door as shown in the FIG. 9.
Figure 9:
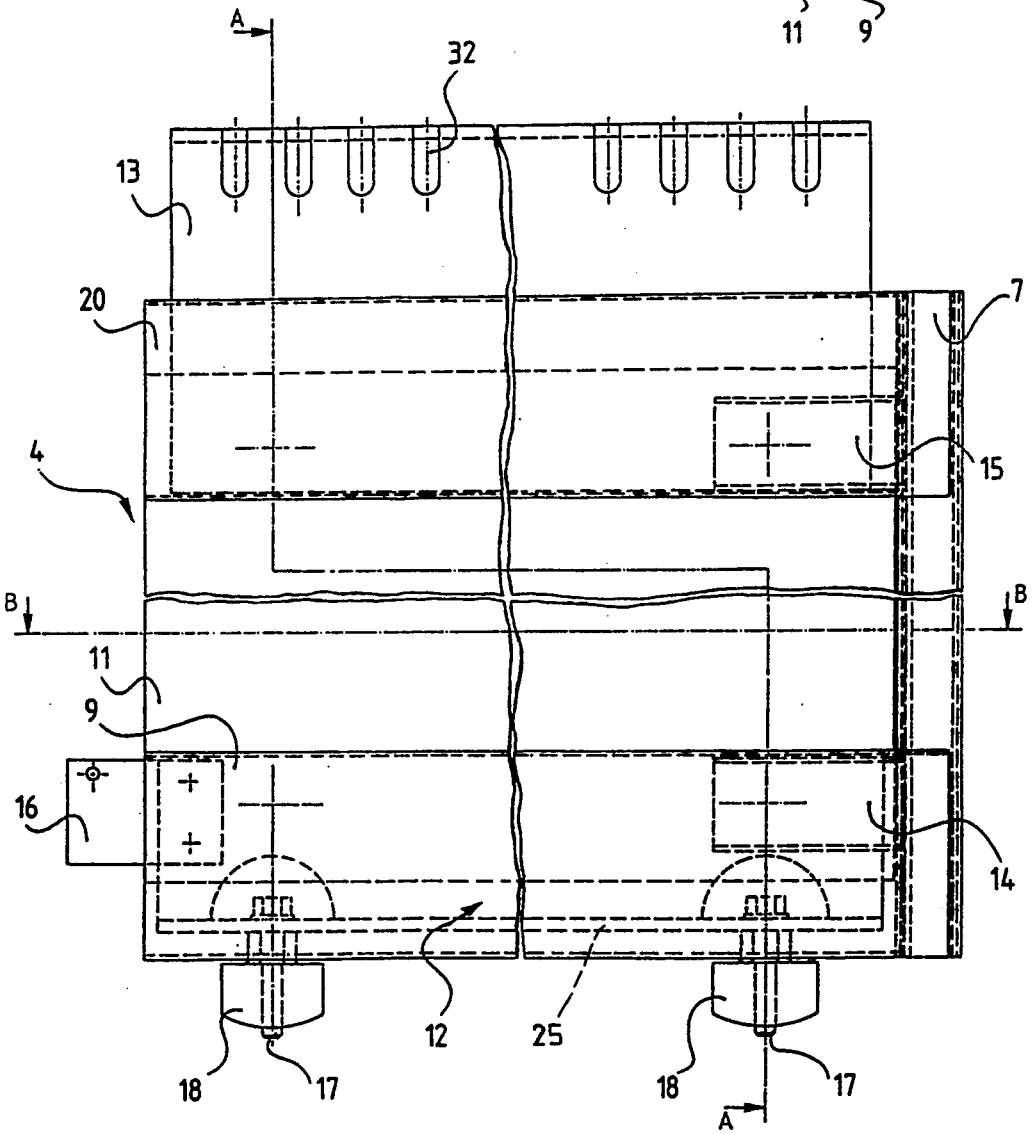
FIG. 9 is a front elevation view of a glass elevator door leaf having a steel edge strip.
Figure 12:
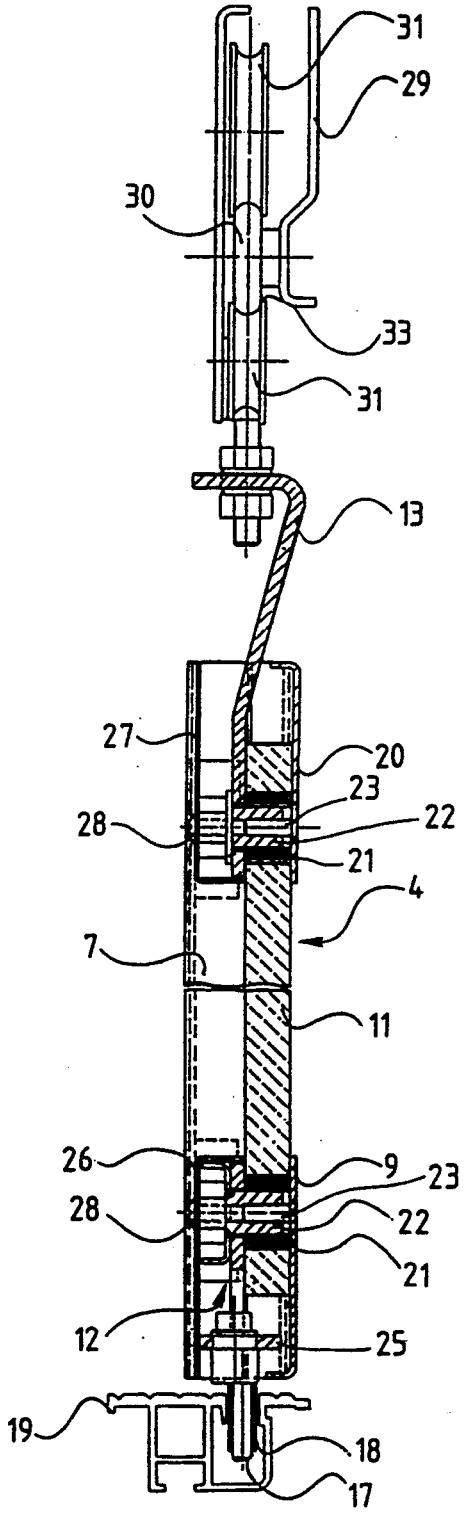
FIG. 12 is a cross-sectional view taken along the line A—A in the FIG. 9.

In the FIGS. 1 to 22, there is shown an elevator entry and exit 1 which is bounded by masonry walls 2 and door posts 3. Glass door leaves 4 forming shaft doors close off the entry and exit 1. An elevator car 6 is guided in a shaft 5 and has an entry and exit which is closed by car doors formed of glass door leaves 4'. The glass door leaves 4 and 4' have steel edge strips 7 (FIGS. 1 and 2) or glass edge strips 8 (FIGS. 5 and 6) attached to abutting vertical edges and lower base strips 9 attached along the bottom edges. As shown in the FIGS. 3 and 4, relatively narrow glass door leaves 4 and 4' are encompassed by frames 10 to provide additional strength. The outer surfaces of the steel edge strips 7 or the frames 10 can be manufactured in chrome steel, steel plate, anodized light metal, polished brass or other decorative finishes according to the requirements for the appearance of the entryway 1.

The glass door leaf 4 with the steel edge strip 7 is illustrated in more detail in the FIGS. 9 to 15. A glass pane 11 has a lower or bottom edge attached to a guide shoe plate 12 and an upper or top edge attached to a hanger bracket 13. The steel edge strip 7 is positioned along the abutting vertical edge of the pane 11 in the closing region and is retained by a lower strip carrier 14 attached to the plate 12 and by an upper strip carrier 15 attached to the bracket 13. A retaining plate 16, which a closing spring (not shown) engages, is attached to the guide shoe plate 12 on the end thereof opposite the steel edge strip 7 and the carrier 14. For the sliding guidance of the lower end of the glass door leaf 4, a pair of eccentric pins 17 are attached to a guide shoe strip 25 formed along a lower edge of the guide shoe plate 12. The pins 17 have guide shoes 18 attached thereto which extend into a threshold profile 19 which is mounted in a not illustrated threshold along the displacement path of the elevator doors. The guide shoe plate 12 provides the glass door leaf 4 with the necessary stability in the base or lower region for withstanding extreme forces.

The glass pane 11 is retained at its lower end between the lower base strip 9 and a glass-retaining strip 24 formed on the guide shoe plate 12 as well as at its upper end between an upper base strip 20 and the hanger bracket 13.

For the smoothing-out of small irregularities in abutting surfaces, double-sided adhesive tape is provided at the contact surfaces between the glass and the metal. Rubber bushings 21 are set into bores provided in the glass pane 11 and encompass fastening nuts 22 which are inserted from the shaft side of the door and engage with welding pins 23 attached to and extending from the base strips 9 and 20. On the shaft side, the glass door leaf 4 has a lower covering 26 at the lower end and an upper covering 27 at the upper end thereof, which coverings are retained at the fastening nuts 22 by means of screws 28. A carrier 29 supports a guide rail 30 which extends along the displacement path and on which move rollers 31. The rollers carry the glass door leaf 4 and are rotatably mounted on the hanger bracket 13 by means of threaded bolts (not shown) engaging elongate holes 32 formed in the bracket. A radially extending raised collar or flange 33 is formed on each edge of the roller 31 to define a peripheral groove which engages a curved surface formed on the rail 30 to assure a secure guidance and prevent the glass door leaf 4 from jumping off of the guide rail 30.

Figure 13:
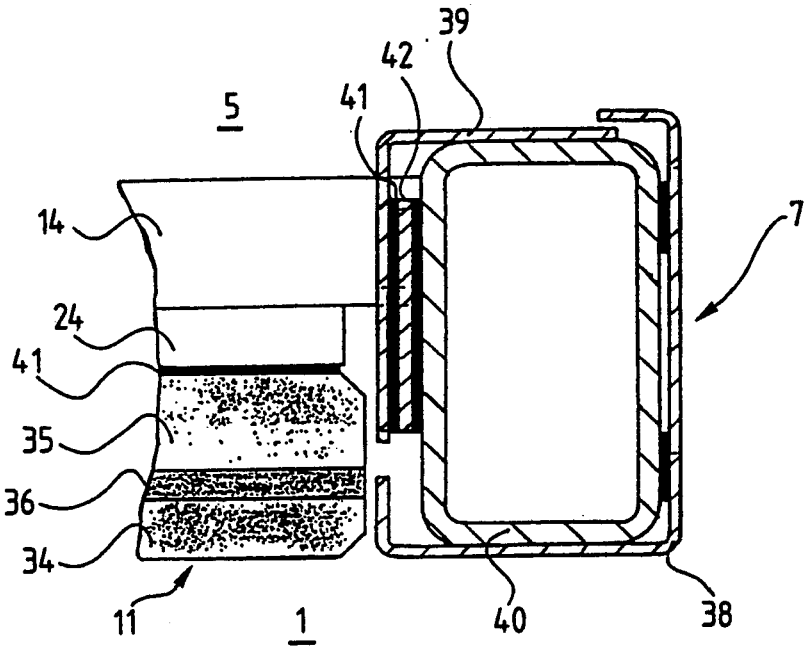
FIG. 13 is an enlarged fragmentary view of the details of the steel edge strip for the shaft door shown in the FIG. 10.
Figure 14:
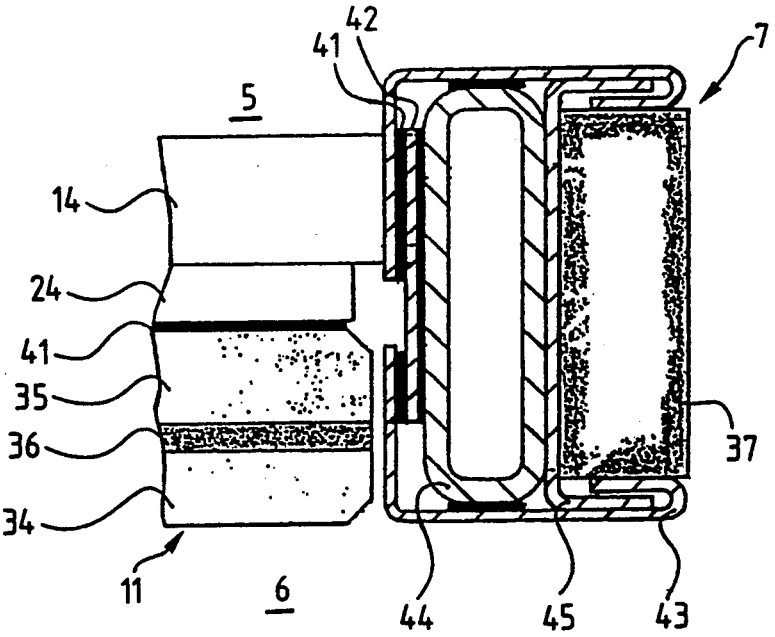
FIG. 14 is an enlarged fragmentary view of the details of the steel edge strip for the car door shown in the FIG. 11.
Figure 15:
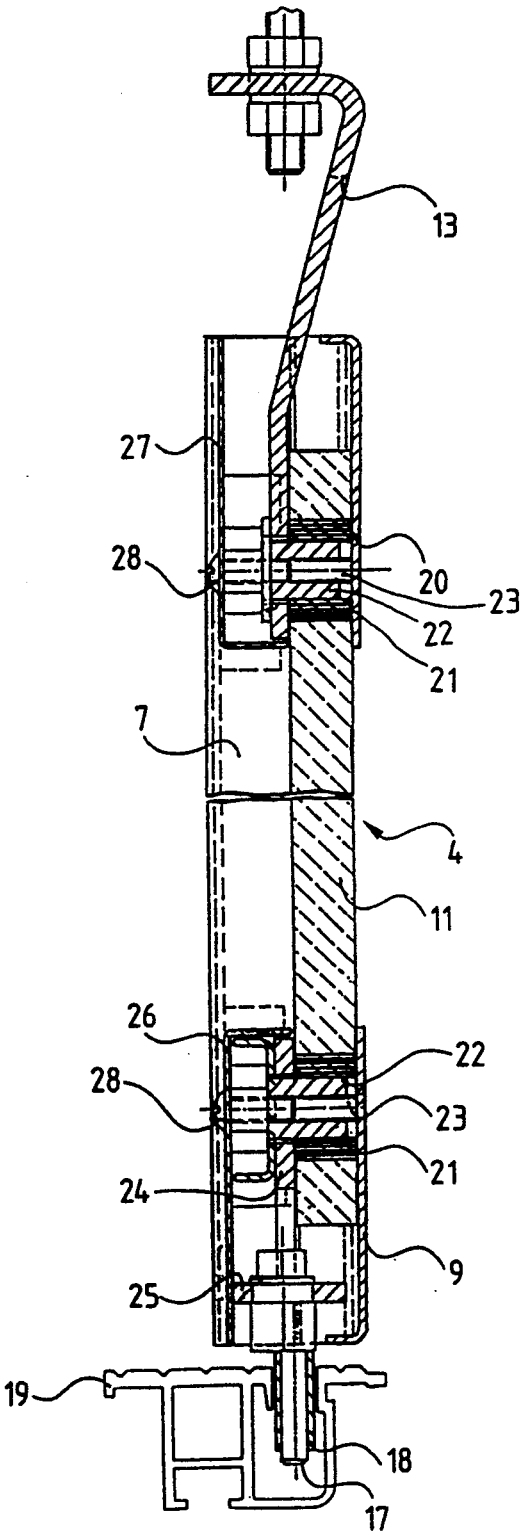
FIG. 15 is an enlarged cross-sectional view showing the details of the glass door leaf with steel edge strip shown in the FIG. 12.

There is shown in the FIGS. 13 and 14 a compound safety glass pane 11 consisting of a first glass layer 34 and a second glass layer 35, which layers are connected by a foil 36. In the case of damage to the glass layers 34 and 35, the foil 36 acts to bind the glass splinters together. Beyond that, the foil 36 is used for decorative purposes in that the glass door leaves can be manufactured with toned and/or transparent colored and/or patterned foils. The bores into which the rubber bushings 21 are inserted are for production-technical reasons made in each of the glass layers 34 and 35. Thereafter, the assembly of the first glass layer 34 with the second glass layer 35 takes place which leads to misalignment of the bores. In order that a problem-free assembly of the glass door leaf 4, in particular the assembly of the fastening nuts 22 and of the base strips 9 and 20 with the welding pins 23, is possible, sufficient play is provided between the rubber bushings 21 and the fastening nuts 22. In addition, soft rubber bushings 21 are used for the avoidance of stresses which would tend to fracture the glass pane 11.

The steel edge strip 7 assures a prescribed minimum width at the leaf edge in the closing region and beyond that enables the positioning of a personnel detector 37 at the car door edge as shown in the FIG. 14. The steel edge strip 7 of a glass door leaf 4 forming a shaft door, as shown in the FIG. 13, consists of a front protective profile 38 and of a rear protective profile 39, which profiles surround a wide edge strip 40 and are connected to the strip 40 by a double-sided adhesive tape 41. A metal spacer plate 42 provides the necessary depth adaptation. The steel edge strip 7 of a glass door leaf 4 forming the car door consists of a U-shaped covering profile 43 which surrounds a narrow edge strip 44 and has a recess formed in the vertical edge to provide space for the personnel detector 37. A metal screening plate 45 is positioned between the narrow edge strip 44 and the personnel detector 37.

Figure 16:
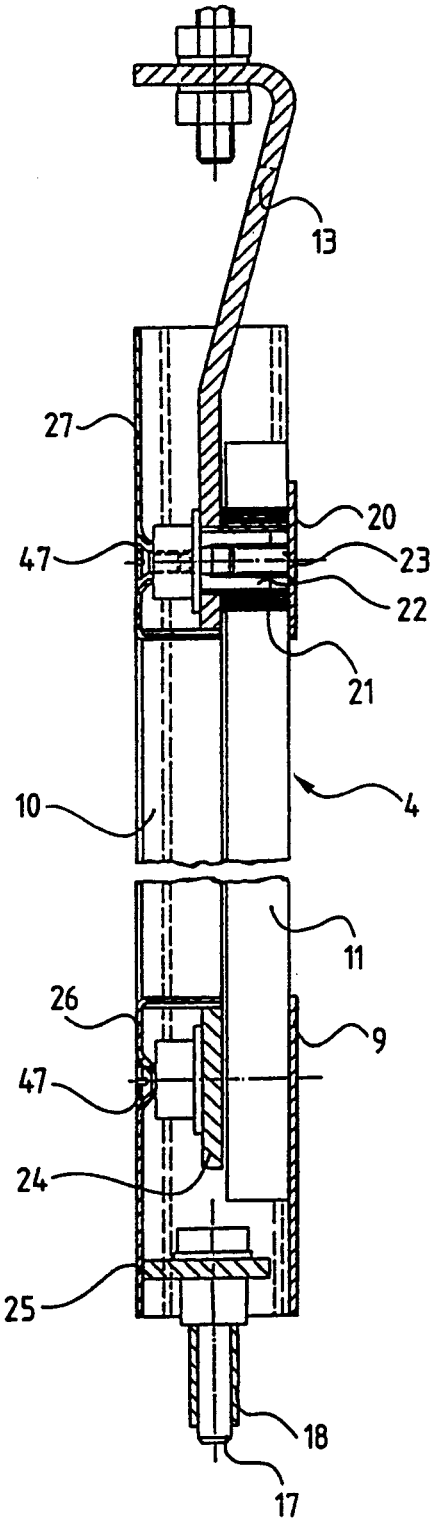
FIG. 16 is a cross-sectional view, similar to the FIG. 15, of a glass door leaf with an encompassing frame.
Figure 19:
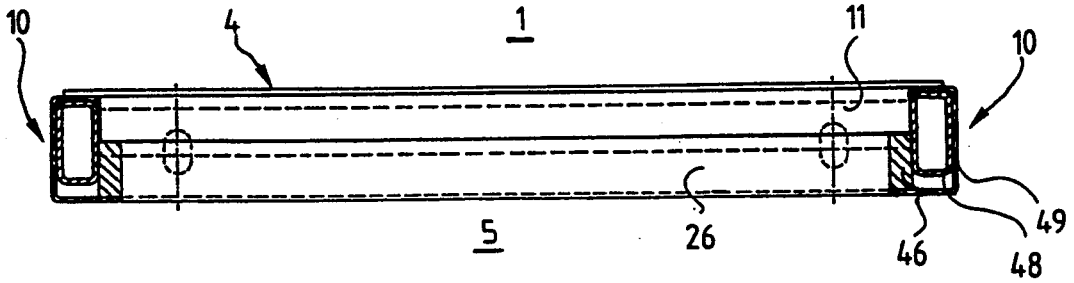
FIG. 19 is a top plan view in cross section, similar to the FIG. 10, of a glass door leaf with a frame for shaft doors.
Figure 20:
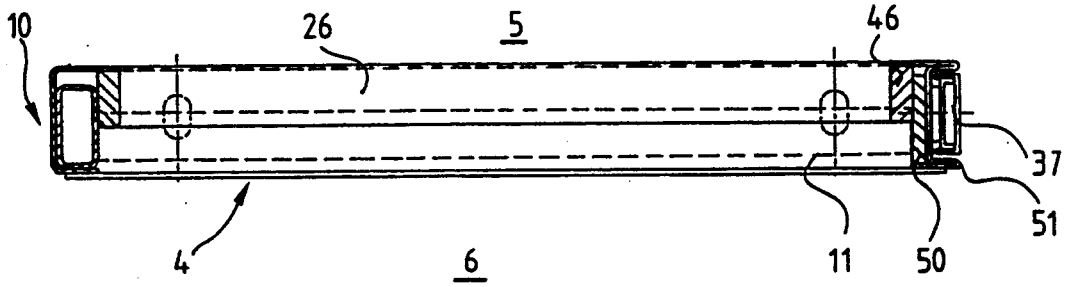
FIG. 20 is a top plan view in cross section, similar to the FIG. 11, of a glass door leaf with a frame for car doors.

In the FIGS. 16, 19 and 20, the glass door leaf 4 with the glass pane 11 carried by the frame 10 is illustrated as variant of embodiment with the steel edge strip 7. Frame carriers 46 are positioned at the vertical edges of the leaf and connected at the lower end of the glass door leaf 4 with the glass-retaining strip 24 and with the guide shoe strip 25 as well as at the upper end of the glass door leaf with the hanger bracket 13. The coverings 26 and 27 are fastened by countersunk head screws 47 to save space. The remaining fastening means correspond to those used with the door having the steel edge strip 7. In the case of the glass door leaves 4 for the shaft doors shown in the FIG. 19, a frame strip 48 is positioned at the frame carrier 46 and is enclosed by a frame profile 49. In the case of the glass door leaves 4 for the car doors shown in the FIG. 20, in place of the frame strip 48 at the abutting edge in the closing region, a metal frame plate 50 is provided, which plate is encompassed by a U-shaped frame covering 51 having a U-shaped recess formed therein for receiving the personnel detector 37.

Figure 17:
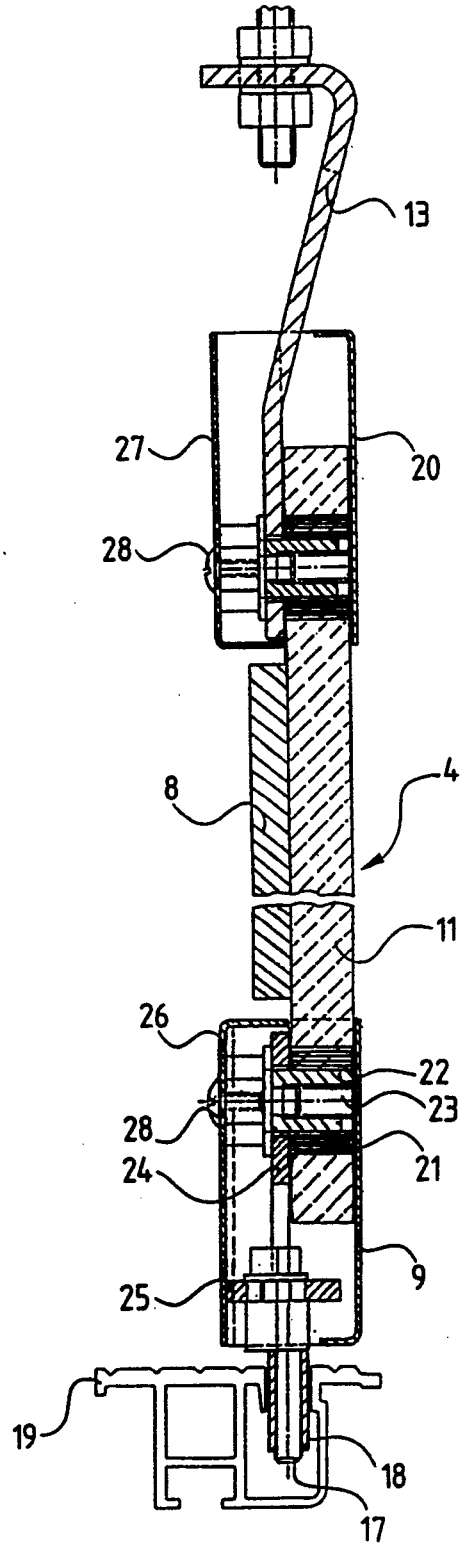
FIG. 17 is a cross-sectional view, similar to the FIG. 15, of a glass door leaf with a glass edge strip.
Figure 21:
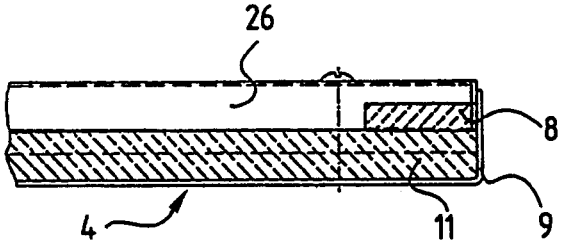
FIG. 21 is a top plan view in cross section of a glass door leaf with a glass edge strip.

In the FIGS. 17 and 21, the glass door leaf 4 with the glass edge strip 8 is illustrated as a variant embodiment. In place of the steel edge strip 7 at the abutting edge in the closing region, the glass edge strip 8 is glued onto the glass pane 11 is provided for the maintenance of the prescribed edge width. The fastening means at the lower end and at the upper end of the glass door leaf 4 correspond to those used with the steel edge strip 7. A personnel detector (not shown) positioned between the car door and the shaft door is provided for the monitoring of the door region.

Figure 18:
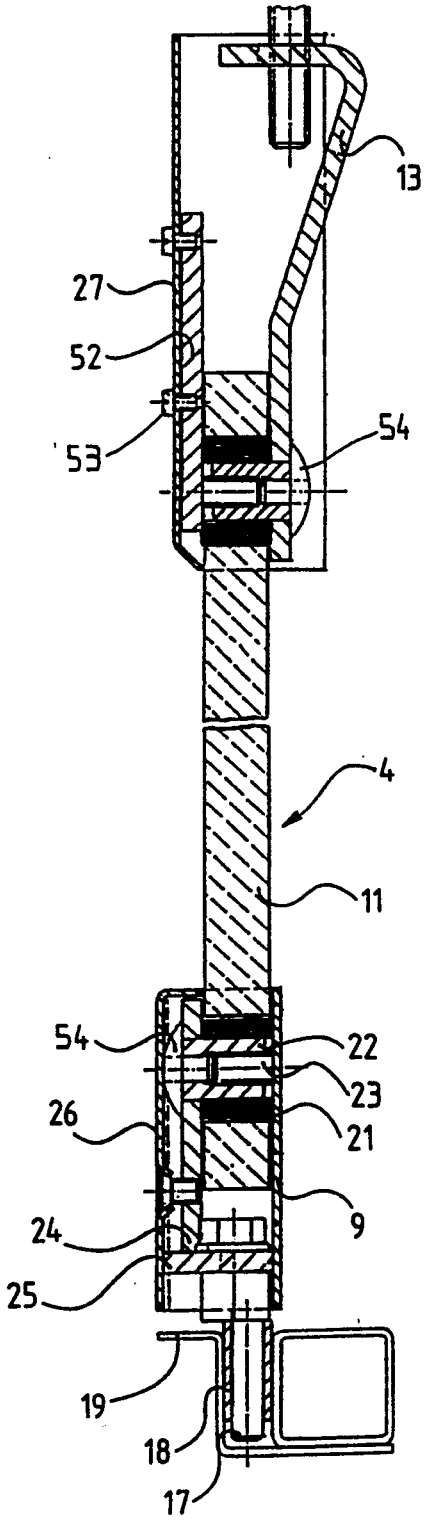
FIG. 18 is a cross-sectional view, similar to the FIG. 15, of a glass door leaf without an edge strip.
Figure 22:
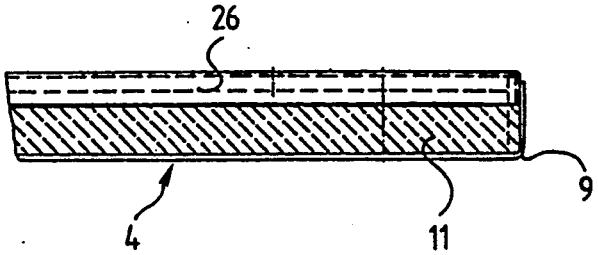
FIG. 22 is a top plan view in cross section of a glass door leaf without an edge strip.

In the FIGS. 18 and 22, the glass door leaf 4 without an edge strip is illustrated as variant of the previously described embodiments. The edge width presented by the glass pane thickness is less than the prescribed minimum width. By way of compensation, the closing force produced by the door drive is therefore reduced in correspondence with the reduced edge width. For reasons of space, an L-shaped guide shoe plate having the glass-retaining strip 24 and the guide shoe strip 25 is used in place of the T-shaped guide shoe plate 12. For the same reason, fastening nuts 54 with half-round heads are used. At the upper end of the glass door leaf 4, the glass pane 11 is retained between the hanger bracket 13 positioned on the user side and a glass-retaining plate 52 with welding pins 53 positioned at the shaft side of the door.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A glass door leaf for elevators having a smooth surface for facing an elevator shaft entryway comprising: a glass pane having apertures formed at an upper end and a lower end thereof; a lower base strip having welding pins attached thereto extending into said apertures in said lower end of said glass pane for retaining said lower base strip on said glass pane; a glass-retaining strip mounted on an opposite side of said glass pane from said lower base strip at said lower end by fastening nuts engaging said welding pins attached to said lower base strip; an upper base strip having welding pins attached thereto extending into said apertures in said upper end of said glass pane for retaining said upper base strip on said glass pane; a hanger bracket mounted on an opposite side of said glass pane from said upper base strip at said upper end by fastening nuts engaging said welding pins attached to said upper base strip; a guide shoe strip mounted on said lower end of said glass pane with eccentric pins extending downwardly therefrom; and guide shoes attached to said eccentric pins.

2. The glass door leaf according to the claim 1 wherein said upper base strip is a glass-retaining plate with said welding pins attached thereto mounted on the same side of said glass pane as said glass-retaining strip.

3. The glass door leaf according to the claim 1 including soft rubber bushings inserted into said apertures in said glass pane and surrounding said fastening nuts for providing play between said bushings and said fastening nuts.

4. The glass door leaf according to the claim 1 wherein said hanger bracket has rollers mounted thereon which rollers have a raised collar formed along each edge thereof.

5. The glass door leaf according to the claim 4 wherein said glass pane is formed from at least two glass layers which are connected by one of a transparent colored foil and a patterned foil.

6. The glass door leaf according to the claim 1 wherein said glass pane is formed from at least two glass layers which are connected by one of a transparent colored foil and a patterned foil.

7. The glass door leaf according to the claim 1 wherein said glass-retaining strip and said guide shoe strip are connected together to form a T-shaped guide shoe plate.

8. The glass door leaf according to the claim 1 wherein said glass-retaining strip and said guide shoe strip are connected together to form an L-shaped guide shoe plate.

9. The glass door leaf according to the claim 1 including a steel edge strip attached to an abutting edge of said glass pane in a closing region.

10. The glass door leaf according to the claim 9 wherein said steel edge strip includes a wide edge strip surrounded by a front protective profile and by a rear protective profile.

11. The glass door leaf according to the claim 9 wherein said steel edge strip includes a narrow edge strip surrounded by a U-shaped covering profile and by a metal screening plate and a personnel detector is positioned in a U-shaped recess formed by said covering profile.

12. The glass door leaf according to the claim 1 including a frame encompassing said glass pane.

13. The glass door leaf according to the claim 12 wherein said frame includes frame carriers connected at said the lower end of said glass pane to said glass-retaining strip and to said guide shoe strip and connected at said upper end of said glass pane to said hanger bracket.

14. The glass door leaf according to the claim 13 including a frame strip attached to said frame carrier and enclosed by a frame profile attached to said frame carrier.

15. The glass door leaf according to the claim 13 including a metal frame plate attached to said frame carrier and enclosed by a U-shaped frame covering attached to said frame carrier, and a personnel detector positioned in a U-shaped recess formed in said frame covering.

16. The glass door leaf according to the claim 1 including a glass edge strip attached to an abutting edge of said glass pane in a closing region.

17. A glass door leaf for elevators comprising:

a glass pane having apertures formed at an upper end and a lower end thereof;

a lower base strip having welding pins attached thereto extending into said apertures in said lower end of said glass pane for retaining said lower base strip on said glass pane;

a glass-retaining strip mounted on an opposite side of said glass pane from said lower base strip at said lower end by fastening nuts engaging said welding pins attached to said lower base strip;

an upper base strip having welding pins attached thereto extending into said apertures in said upper end of said glass pane for retaining said upper base strip on said glass pane; and a hanger bracket mounted on an opposite side of said glass pane from said upper base strip at said upper end by fastening nuts engaging said welding pins attached to said upper base strip.

18. A glass door leaf for elevators comprising:

a glass pane having apertures formed at an upper end and a lower end thereof;

a lower base strip having welding pins attached thereto extending into said apertures in said lower end of said glass pane for retaining said lower base strip on said glass pane;

a glass-retaining strip mounted on an opposite side of said glass pane from said lower base strip at said lower end by fastening nuts engaging said welding pins attached to said lower base strip;

an upper base strip having welding pins attached thereto extending into said apertures in said upper end of said glass pane for retaining said upper base strip on said glass pane;

a hanger bracket mounted on an opposite side of said glass pane from said upper base strip at said upper end by fastening nuts engaging said welding pins attached to said upper base strip; and soft rubber bushings inserted into said apertures in said glass pane and surrounding said fastening nuts for providing play between said bushings and said fastening nuts.

* * * * *